US010731417B2

(12) United States Patent
Vemuri et al.

(10) Patent No.: US 10,731,417 B2
(45) Date of Patent: Aug. 4, 2020

(54) REDUCED TRIP WELL SYSTEM FOR MULTILATERAL WELLS

(71) Applicant: Halliburton Energy Services, Inc., Houston, TX (US)

(72) Inventors: Srinivasa Prasanna Vemuri, Frisco, TX (US); Matthew Bradley Stokes, Keller, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 257 days.

(21) Appl. No.: 15/760,599

(22) PCT Filed: Dec. 10, 2015

(86) PCT No.: PCT/US2015/065020
§ 371 (c)(1),
(2) Date: Mar. 15, 2018

(87) PCT Pub. No.: WO2017/099780
PCT Pub. Date: Jun. 15, 2017

(65) Prior Publication Data

US 2018/0274300 A1 Sep. 27, 2018

(51) Int. Cl.
*E21B 29/06* (2006.01)
*E21B 7/06* (2006.01)
(Continued)

(52) U.S. Cl.
CPC ..... *E21B 7/061* (2013.01); *E21B 29/06* (2013.01); *E21B 41/0035* (2013.01);
(Continued)

(58) Field of Classification Search
CPC ..... E21B 7/061; E21B 29/06; E21B 41/0035
See application file for complete search history.

(56) References Cited

U.S. PATENT DOCUMENTS 5,311,936 A * 5/1994 McNair ..... E21B 7/061 166/117.6
5,427,177 A * 6/1995 Jordan, Jr. ..... E21B 7/061 166/117.5
(Continued)

FOREIGN PATENT DOCUMENTS

WO WO-03/071084 A2 8/2003
WO WO-2015/187297 A1 12/2015

OTHER PUBLICATIONS

Balstad et al., "New Single-Trip, TAML Level 4, Multilateral Junction Technology Reduces Well Costs in Norwegian Sea Subsea Well—A Case History," SPE 123935, 2009, 11 pages.
(Continued)

*Primary Examiner* — William D Hutton, Jr.
*Assistant Examiner* — Steven A MacDonald
(74) *Attorney, Agent, or Firm* — Scott Richardson; C. Tumey Law Group PLLC

(57) ABSTRACT

A method includes conveying a washover whipstock coupled to an orienting latch anchor into a parent wellbore lined with casing and securing the orienting latch anchor to the casing. A washover tool couples to and removes the washover whipstock from the parent wellbore, and thereby exposes a releasable orienting coupling of the orienting latch anchor. A workover whipstock coupled to a junction isolation tool is then conveyed into the parent wellbore and the workover whipstock is coupled to the orienting latch anchor at the releasable orienting coupling. The junction isolation tool is separated from the workover whipstock and advanced into the lateral wellbore, following which the junction isolation tool is retracted back into the parent wellbore to be re-attached to the workover whipstock to remove the workover whipstock from the parent wellbore.

20 Claims, 10 Drawing Sheets

(51) Int. Cl.
*E21B 41/00* (2006.01)
*E21B 43/10* (2006.01)
*E21B 43/14* (2006.01)

(52) U.S. Cl.
CPC ..... *E21B 41/0042* (2013.01); *E21B 43/10* (2013.01); *E21B 43/14* (2013.01)

(56) References Cited

U.S. PATENT DOCUMENTS

| | | | | |
|---|---|---|---|---|
| 5,435,392 | A * | 7/1995 | Kennedy | E21B 23/002 166/344 |
| 5,474,126 | A | 12/1995 | Lynde et al. | |
| 6,311,776 | B1 * | 11/2001 | Pringle | E21B 23/002 166/313 |
| 6,497,288 | B2 | 12/2002 | George et al. | |
| 6,648,069 | B2 | 11/2003 | Dewey et al. | |
| 6,755,248 | B2 | 6/2004 | Toulouse et al. | |
| 7,207,401 | B2 | 4/2007 | Dewey et al. | |
| 2001/0040054 | A1 | 11/2001 | Haugen et al. | |
| 2008/0185148 | A1 | 8/2008 | Carter et al. | |
| 2013/0319693 | A1 | 12/2013 | Sponchia et al. | |
| 2016/0145956 | A1 * | 5/2016 | Dahl | E21B 7/061 166/382 |

OTHER PUBLICATIONS

International Search Report and Written Opinino from PCT/US2015/065020, dated Feb. 15, 2016, 15 pages.

* cited by examiner

REDUCED TRIP WELL SYSTEM FOR MULTILATERAL WELLS

BACKGROUND

Multilateral technologies allow an operator to drill a parent wellbore and subsequently drill a lateral wellbore extending from the parent wellbore at a desired orientation and to a chosen depth.

To drill a multilateral well, the parent wellbore is first drilled and then at least partially lined with a string of casing or another type of wellbore liner. The casing is cemented into the wellbore to strengthen the parent wellbore and facilitate the isolation of certain areas of the formation behind the casing for the extraction and production of hydrocarbons. To drill a lateral wellbore from the parent wellbore, a casing exit (alternately referred to as a "window") is created in the casing of the parent wellbore. The casing exit can be formed, for example, by positioning a whipstock at a predetermined location in the parent wellbore to deflect one or more mills off the whipstock and into engagement with the casing to mill through the casing. A drill bit can be subsequently deflected through the casing exit to drill the lateral wellbore, which can then be completed as desired.

Once the lateral wellbore is drilled and completed, stimulation operations may be undertaken in the lateral wellbore by installing a lateral junction isolation tool at the junction between the parent and lateral wellbores. To install the lateral junction isolation tool, a workover whipstock is commonly first installed at the junction to deflect the lateral junction isolation tool partially into the lateral wellbore so that it can be set and provide a transition between the parent and lateral wellbores. Upon completing the stimulation operation in the lateral wellbore, the lateral junction isolation tool is pulled out of the well and a subsequent trip downhole is made to retrieve the workover whipstock, and thereby providing full access to the parent wellbore. A mainbore junction isolation tool is then installed at the junction between the parent and lateral wellbores to undertake stimulation operations in lower portions of the parent wellbore.

This process of stimulating both the parent and lateral wellbores in a multilateral wellbore can be trip intensive; i.e., meaning that it can require several downhole trips into the well. Reducing the number of trips into the well while being able to perform the same functions can save a significant amount of time and expense in multilateral operations.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to completing wells in the oil and gas industry and, more particularly, to assemblies that reduce the number of trips required to complete and stimulate parent and lateral wellbores of a multilateral well. Embodiments described herein include systems and methods that reduce the number of trips into a well required to complete a multilateral well. In some examples, a washover whipstock coupled to an orienting latch anchor is conveyed into a parent wellbore lined with casing and the orienting latch anchor is secured to the casing. After milling, drilling, and completing a lateral wellbore extending from the parent wellbore, a washover tool couples to and removes the washover whipstock from the parent wellbore, and thereby exposes a releasable orienting coupling of the orienting latch anchor. A workover whipstock coupled to a junction isolation tool is then conveyed into the parent wellbore and is coupled to the orienting latch anchor at the releasable orienting coupling. The junction isolation tool is separated from the workover whipstock and advanced into the lateral wellbore to undertake one or more wellbore operations within the lateral wellbore, such as a hydraulic fracturing operation. Following the wellbore operation(s), the junction isolation tool can be retracted back into the parent wellbore and re-attached to the workover whipstock to remove the workover whipstock from the parent wellbore.

The releasable orienting coupling of the orienting latch anchor is also able to angularly orient the workover whipstock with respect to a casing exit for the lateral wellbore. With the help of measurement-while-drilling technology, this enables tripping of the workover whipstock without the need to rotate and latch in for proper azimuthal orientation. Moreover, since the junction isolation tool is run downhole attached to the workover whipstock, this eliminates the need to run the junction isolation tool in a separate run downhole. The orienting latch anchor can be equipped with a fluid loss control device (e.g., a plug) that is installed with the washover whipstock and, following the milling, drilling, and completing of the lateral wellbore, the fluid loss control device can be retrieved along with workover whipstock. This eliminates two trips downhole to run the fluid loss control device separately before milling and retrieving the fluid loss control device following the lateral wellbore operations.

FIGS. 1-10 are progressive cross-sectional side views of the construction of an exemplary well system 100 that may employ the principles of the present disclosure. Similar numbers used in any of FIGS. 1-10 refer to common elements or components that may not be described more than once.

Figure 1:
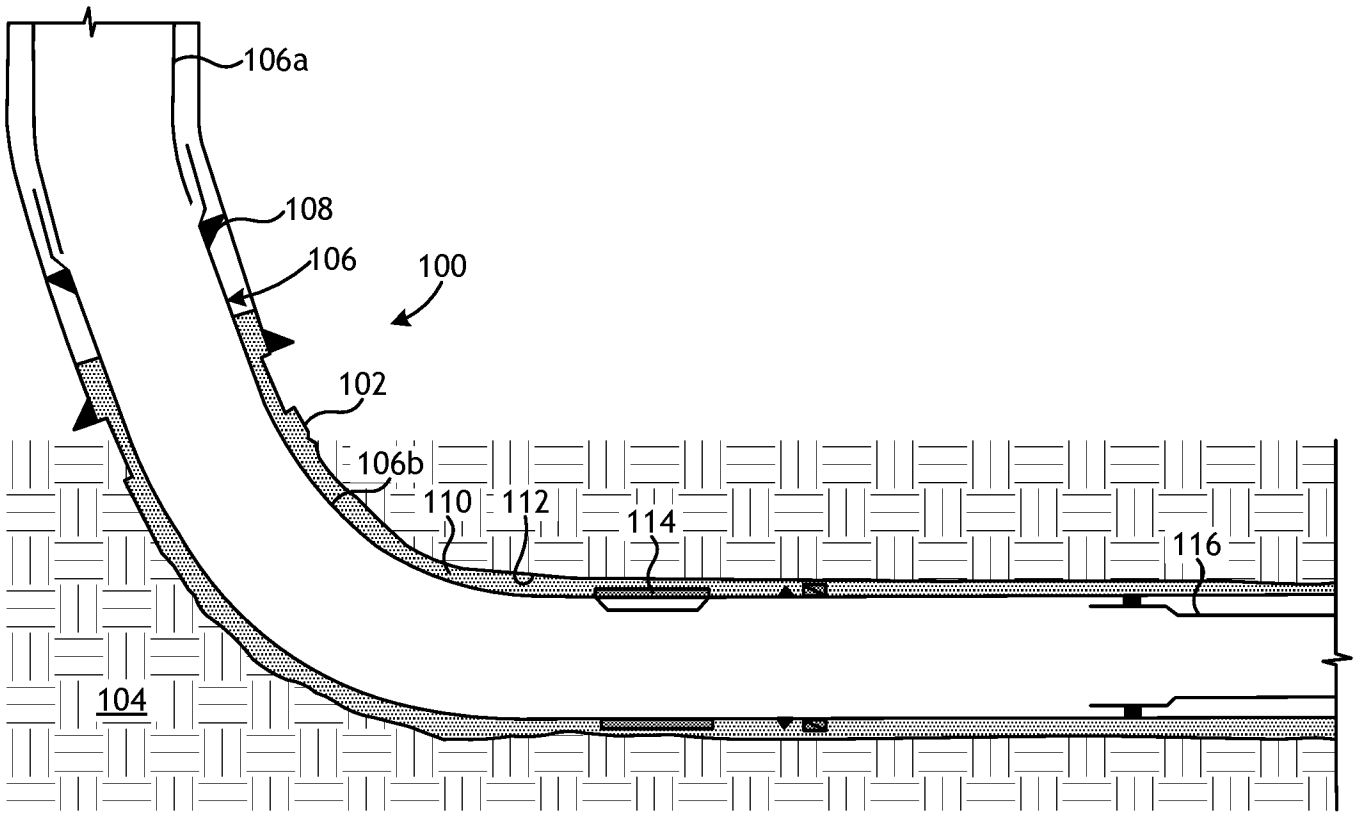
FIG. 1 is a cross-sectional side view of a well system that may employ from the principles of the present disclosure.

Referring first to FIG. 1, illustrated is a cross-sectional side view of the well system 100 including a parent wellbore 102 drilled through various subterranean formations, including formation 104, which may comprise a hydrocarbon-bearing formation. Following drilling operations, the parent wellbore 102 may be completed by lining all or a portion of the parent wellbore 102 with casing 106, shown as a first string of casing 106*a* and a second string of casing 106*b* that extends from the first string of casing 106*a*. The first string of casing 106*a* may extend from a surface location (i.e., where a drilling rig and related drilling equipment are located) or may alternatively extend from an intermediate point between the surface location and the formation 104. The second string of casing 106*b* may be coupled to and otherwise "hung off" from the first string of casing 106*a* at a liner hanger 108.

For purposes of the present disclosure, the first and second strings of casing 106*a,b* will be jointly referred to herein as the casing 106. All or a portion of the casing 106 may be secured within the parent wellbore 102 by depositing cement 110 within the annulus 112 defined between the casing 106 and the wall of the parent wellbore 102.

In some embodiments, the casing 106 may include a pre-milled window 114. The pre-milled window 114 may be covered with a millable or soft material that may be penetrated (e.g., milled through) to provide a casing exit used to form a lateral wellbore that extends from the parent wellbore 102. In other embodiments, however, the pre-milled window 114 may be omitted from the well system 100 and the casing exit may instead be created by penetrating the wall of the casing 106 at the desired location.

After the casing 106 has been cemented, a lower liner 116 may be extended into the parent wellbore 102 and secured to the inner wall of the casing 106 at a predetermined location downhole from the pre-milled window 114 or otherwise adjacent the location where the casing exit is to be formed. While not shown, the lower liner 116 may include at its distal end various downhole tools and devices used to extract hydrocarbons from the formation 104, such as well screens, inflow control devices, sliding sleeves, valves, etc.

Figure 2:
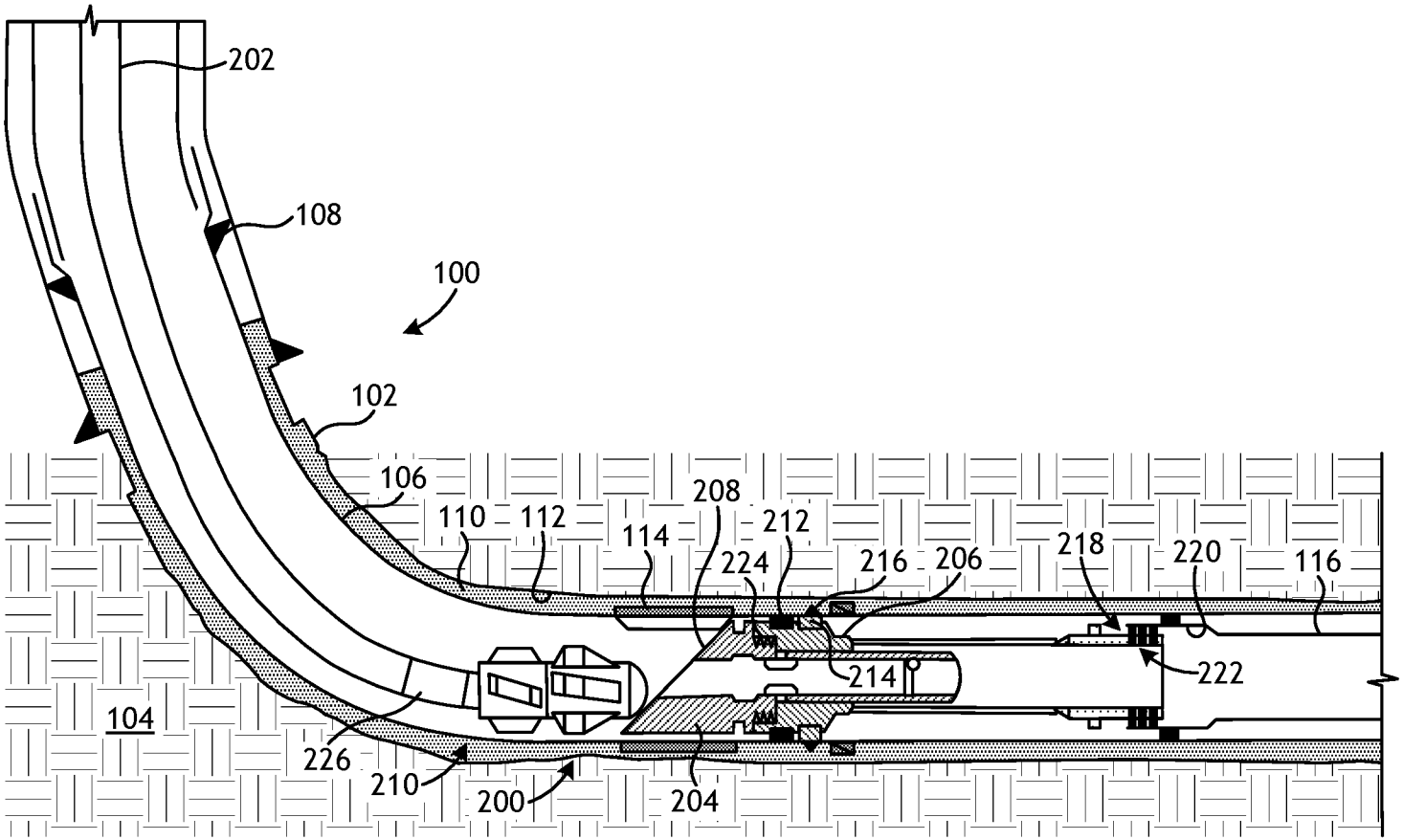
FIG. 2 depicts a cross-sectional side view of an exemplary whipstock and deflector assembly.

In FIG. 2, once the parent wellbore 102 is completed, a whipstock and deflector assembly 200 is conveyed into the parent wellbore 102 on a drill string 202, which may comprise a plurality of lengths of drill pipe coupled end-to-end. As illustrated, the whipstock and deflector assembly 200 (hereafter "the assembly 200") may include a washover whipstock 204 operatively coupled to an orienting latch anchor 206. The washover whipstock 204 comprises a ramped surface 208 that urges one or more mills 210 into the wall of the casing 106 to mill through the pre-milled window 114. The mills 210 may be coupled to the washover whipstock 204 with, for example, a torque bolt (not shown) that allows the drill string 202 to apply torque to the assembly 200 as it is run downhole to the target location. Once the torque bolt is sheared, the mills 210 may then be free to mill through the pre-milled window 114 to create the casing exit.

The orienting latch anchor 206 may include a seal 212 and a latch profile 214 matable with a latch coupling 216 provided in the casing 106 at or near the pre-milled window 114. As the assembly 200 is lowered into the parent wellbore 102, the latch profile 214 is able to locate and couple to the latch coupling 216 and thereby secure the assembly 200 in place within the parent wellbore 102. Mating the latch profile 214 with the latch coupling 216 also serves to azimuthally orient the assembly 200 within the parent wellbore 102 such that the ramped surface 208 is aligned generally with the pre-milled window 114 and otherwise aligned with an angular location where the casing exit is to be formed. The seal 212 may be engaged and otherwise activated to prevent fluid migration across the orienting latch anchor 206 at the interface between the orienting latch anchor 206 and the inner wall of the casing 106.

In some embodiments, the assembly 200 may further include a lower stinger assembly 218 that extends from the orienting latch anchor 206 and is configured to be received within a seal bore 220 of the lower liner 116. In at least one embodiment, the seal bore 220 may be a polished bore receptacle and the lower stinger assembly 218 may include one or more seals 222 that sealingly engage the inner wall of the seal bore 220, and thereby provide fluid and/or hydraulic isolation with the lower liner 116. Alternatively, the seal bore 220 may carry the seals 222 to sealingly engage the outer surface of the stinger assembly 218. In other embodiments, however, lower stinger assembly 210 may be omitted or otherwise not engageable with the lower liner 116, without departing from the scope of the disclosure.

The washover whipstock 204 may be operatively coupled to the orienting latch anchor 206 via a releasable orienting coupling 224 that allows the washover whipstock 204 to be subsequently separated from the orienting latch anchor 206 and retrieved to the surface location, as discussed below. The releasable orienting coupling 224 may comprise any connection mechanism or device that can be repeatedly locked and released as desired, while simultaneously maintaining both depth and orientation datums relative to the latch coupling 216 when initially installed. Accordingly, the releasable orienting coupling 224 is able to orient subsequent assemblies to the same predetermined angular orientation relative to the pre-milled window 114.

In some embodiments, the releasable orienting coupling 224 may comprise a collet or collet device. In other embodiments, however, the releasable orienting coupling 224 may comprise a latching profile, such as a lug-style receiving head with scoop guide. One suitable latching profile is the RATCH-LATCH® device available from Halliburton Energy Services of Houston, Tex., USA. The releasable orienting coupling 224 may further include an orienting muleshoe used to angularly orient an assembly or tool (e.g., the washover whipstock 204) to a predetermined orientation, such as with respect to the pre-milled window 114. The orienting muleshoe may include one or more lugs, guide channels, J-channels, gyroscopes, positioning sensors, actuators, etc., that may be used to help orient the assembly or tool to the predetermined angular orientation.

With continued reference to FIG. 2, exemplary operation of running the assembly 200 into the parent wellbore 102 is now provided. In some embodiments, the drill string 202 may include a measurement-while-drilling ("MWD") tool 226 used to orient the assembly 200 within the parent wellbore 102 and help locate the latch coupling 216. The MWD tool 226 may include one or more sensors that measure the angular (azimuthal) orientation of the assembly 200 and is configured to transmit orientation measurement obtained by the sensors to the surface location for consideration. For example, the MWD tool 226 may be configured to transmit measurement data via wireless communication means, such as mud pulse telemetry, acoustic telemetry, electromagnetic telemetry, radio frequency, or via wired communication, such as electrical wires or fiber optics. Consequently, the MWD tool 226 helps ensure that the washover whipstock 204 and the mills 210 are properly oriented relative to the pre-milled window 114 to form the casing exit at the desired angular orientation.

As the assembly 200 advances toward the target location, measurements obtained by the MWD tool 226 may help a well operator angularly orient the assembly 200 with respect to the pre-milled window 114 to within +/−15° and thereby provide a general desired angular orientation. The latch coupling 216, however, may be configured to fully orient the assembly 200 to the desired orientation once coupled to the orienting latch anchor 206. More specifically, the latch profile 114 of the orienting latch anchor 206 may locate and engage the latch coupling 216, which orients the orienting latch anchor 206 to a predetermined angular orientation relative to the pre-milled window 114.

Before or while the orienting latch anchor 206 is being oriented to the predetermined angular orientation, the lower stinger assembly 218 may be received into the seal bore 220 and thereby provide fluid and/or hydraulic isolation between the casing 106 and the lower liner 116. Once the orienting latch anchor 206 is secured to the casing 106, the mills 210 may then be detached from the washover whipstock 204 by placing an axial load on the assembly 200 in the downhole direction and thereby shearing the torque bolt (or another coupling device) that couples the mills 210 to the washover whipstock 204. The mills 210 are then free to move with respect to the washover whipstock 204 as manipulated by axial movement of the drill string 202.

Figure 3:
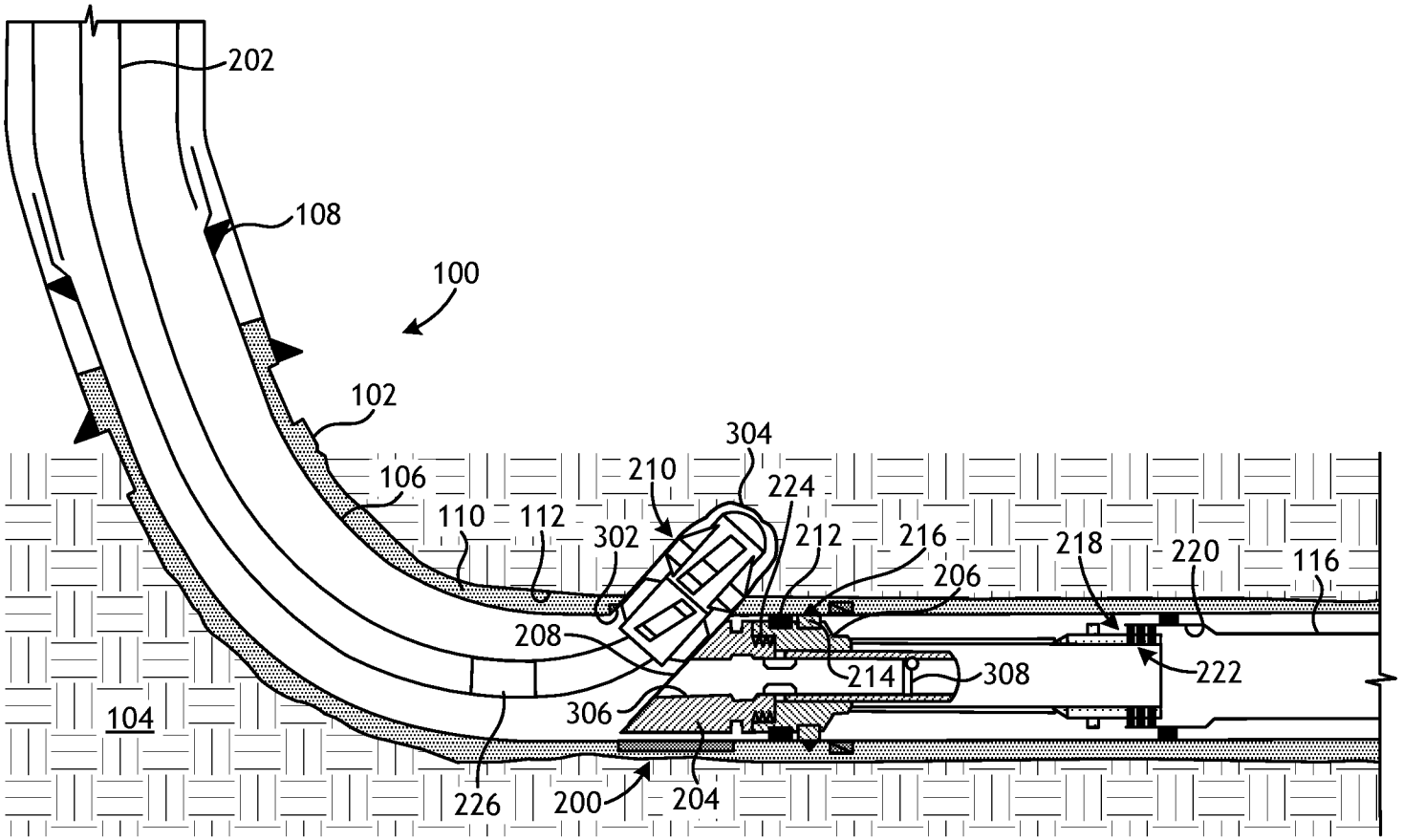
FIG. 3 depicts the creation of a casing exit by moving the mills into engagement with the casing.

FIG. 3 shows the drill string 202 moving the mills 210 in the downhole direction relative to the washover whipstock 204, which urges the mills 210 to ride up the ramped surface 208 of the washover whipstock 204 and into engagement with the wall of the casing 106 and, more particularly, into contact with the pre-milled window 114. As illustrated, the washover whipstock 204 may define and otherwise provide an inner bore 306, and a diameter of the inner bore 306 may be smaller than an outer diameter of the mills 210 (i.e., the lead mill positioned at the distal end of the drill string 202). As a result, the mills 210 may be prevented from entering the inner bore 306 but are instead forced to ride up the ramped surface 208 of the washover whipstock 204 and into engagement with the wall of the casing 106. Rotating the mills 210 via the drill string 202 will mill out the pre-milled window 114 and thereby create a casing exit 302 in the casing 106 and the start to a lateral wellbore 304 that extends from the parent wellbore 102.

The assembly 200 may also include one or more fluid loss control devices 308, such as a flapper valve, a ball valve, or a plug, located downhole from or adjacent the inner bore 306. The fluid loss control device 308 may isolate lower portions of the parent wellbore 102 from debris resulting from milling the casing exit 302 and subsequent drilling operations. The fluid loss control device 308 may also prevent fluid loss into the lower portions of the parent wellbore 102 while milling the casing exit 302 and drilling the lateral wellbore 304. Installing the fluid loss control device 308 simultaneously with the orienting latch anchor 206 and the washover whipstock 204 may prove advantageous in eliminating a separate trip downhole to install the fluid loss control device 308.

Figure 4:
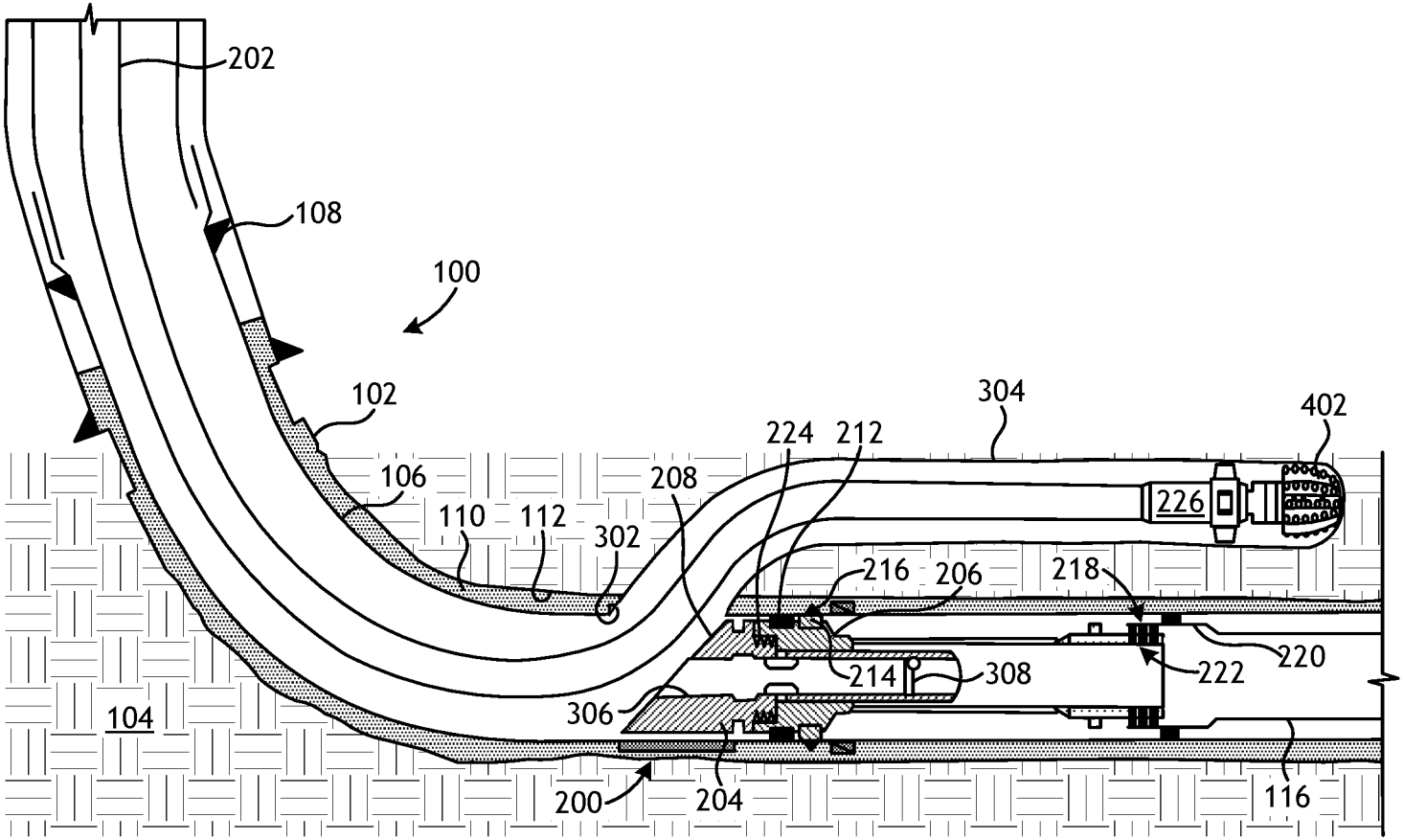
FIG. 4 depicts a lateral wellbore being drilled in the well assembly.

In FIG. 4, once the casing exit 302 is created, the mills 210 (FIGS. 2 and 3) may be retrieved to the surface location and the drill string 202 may subsequently be conveyed back into the parent wellbore 102 with a drill bit 402 installed at its distal end. Similar to the mills 210, the drill bit 402 may exhibit a diameter that is greater than the diameter of the inner bore 306 and, as a result, upon encountering the whipstock 402 the drill bit 402 is forced to ride up the ramped surface 208, through the casing exit 302, and into the start of the lateral wellbore 304. Once in the lateral wellbore 304, the drill bit 402 may be rotated and advanced to drill the lateral wellbore 304 to a desired depth. In some embodiments, the MWD tool 226 may be used to monitor drilling operations and help determine when the desired length or depth of the lateral wellbore 304 is achieved. Once the lateral wellbore 304 is drilled, the drill string 202 and the drill bit 402 may be pulled back into the parent wellbore 102 and retracted to the surface location.

Figure 5:
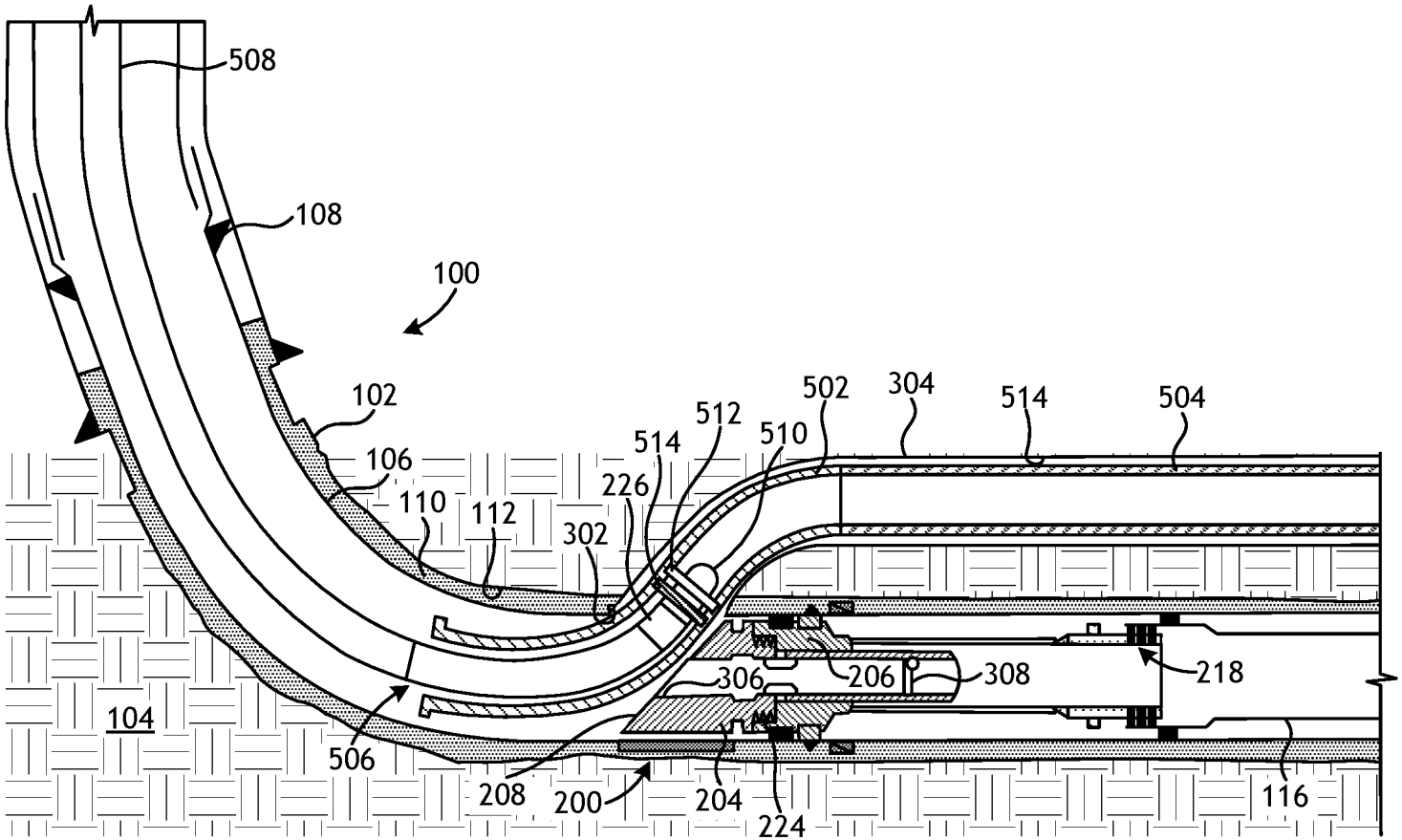
FIG. 5 depicts a lateral transition joint and a lateral liner advanced into the lateral wellbore using a lateral liner running tool.

In FIG. 5, a lateral transition joint 502 and a lateral liner 504 are advanced into the lateral wellbore 304 using a lateral liner running tool 506. The lateral liner running tool 506 may be coupled to a work string 508 that extends from the surface location and may include the MWD tool 226 used to help guide the lateral transition joint 502 to the assembly 200. The work string 508 might be the same as the drill string 202, but could alternatively include production tubing, coiled tubing, or any string of rigid tubular members.

The lateral liner 504 may be operatively coupled (either directly or indirectly) to the bottom end of the lateral transition joint 502 and may include several completion tools or devices used to help complete the lateral wellbore 304 and facilitate hydrocarbon production from the surrounding formation 104. While not shown in FIG. 5, the lateral liner 504 may include, for example, a bullnose arranged at its distal end configured to ride up the ramped surface 208 of the washover whipstock 204 and allow the lateral liner 504 and the lateral transition joint 502 to advance into the lateral wellbore 304. The lateral liner 504 may also include one or more completion tools (not shown) used to regulate and/or control production flow from the formation 104 including, but not limited to, well screens, slotted liners, perforated liners, wellbore packers, inflow control devices, valves, chokes, sliding sleeves, etc.

The lateral liner running tool 506 may be coupled to the lateral transition joint 502 at a running tool head 510. More particularly, the running tool head 510 may be extended within the interior of the lateral transition joint 502 and coupled to the lateral transition joint 502 at a releasable connection 512. The releasable connection 512 may be configured to locate and couple to a profile or another type of coupling provided on the inner radial surface of the lateral transition joint 502. The releasable connection 512 allows the lateral liner running tool 506 to be coupled to and subsequently separated from the lateral transition joint 502. Accordingly, the releasable connection 512 may comprise any connection mechanism or device that can be locked and released as desired such as, but not limited to, a collet, a latching profile, a shearable device (e.g., shear screws, shear pins, shear bolts, a shear ring, etc.), a dissolvable connection, a disappearing-type (degradable) connection, a pressure-release connection, a magnetic-release connection, and any combination thereof.

The lateral liner running tool 506 may further include one or more radial seals 514 configured to sealingly engage the inner radial surface of the lateral transition joint 502. The radial seals 514 may include, but are not limited to, metal-to-metal seals, elastomeric seals (e.g., O-rings or the like), crimp seals, and any combination thereof. The radial seals 514 provide a point of fluid isolation within the lateral transition joint 502 and the lateral liner 504 so that the lateral wellbore 304 might be completed with cement. More particularly, once the lateral liner 504 is properly positioned within the lateral wellbore 304, the lateral liner 504 may be cemented into the lateral wellbore 304. This may be accomplished by discharging cement out of the running tool head 510, circulating the cement through the interior of the lateral liner 504 and out its distal end, and flowing the cement into the annulus 514 formed between the liner 504 and the inner wall of the lateral wellbore 304. In other embodiments, however, the liner 504 may be secured within the lateral wellbore 304 using other means besides cement, such as mechanical fasteners, an interference fit, etc.

After the lateral liner 504 is cemented in place in the lateral wellbore 304, the lateral liner running tool 506 may be detached from the lateral transition joint 502 and pulled back into parent wellbore 102 to be retrieved to the surface location. To accomplish this, an axial load may be applied to the lateral liner running tool 506 in the uphole direction (i.e., to the left in FIG. 5) by pulling the work string 508 uphole and toward the surface location. The axial load applied to the lateral liner running tool 506 may be assumed by the releasable connection 512 and, upon assuming a predetermined axial load in the uphole direction, the releasable connection 512 may detach from the lateral transition joint 502 and thereby free the lateral liner running tool 506 from the lateral transition joint 502. At this point, the lateral liner running tool 506 may be pulled back into the parent wellbore 102 to be retrieved to the surface location.

Figure 6:
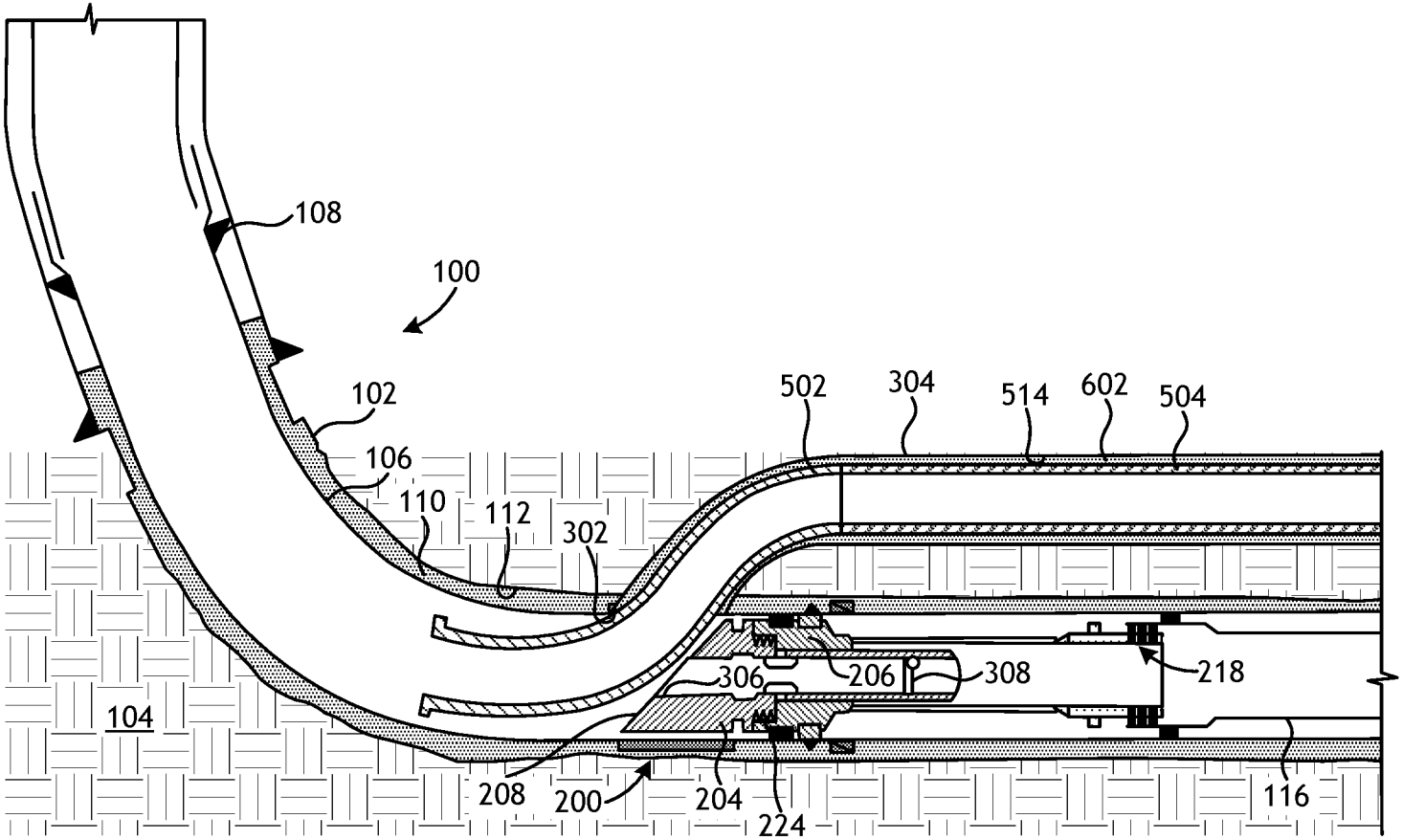
FIG. 6 depicts the lateral liner cemented into place within the lateral wellbore.

FIG. 6 depicts the lateral liner 504 as cemented into place with cement 602 within the lateral wellbore 304. As illustrated, at least a portion of the lateral transition joint 502 may also be cemented into the lateral wellbore 304 while another portion of the uphole end of the lateral transition joint 502 extends into the parent wellbore 102 via the casing exit 302.

Figure 7:
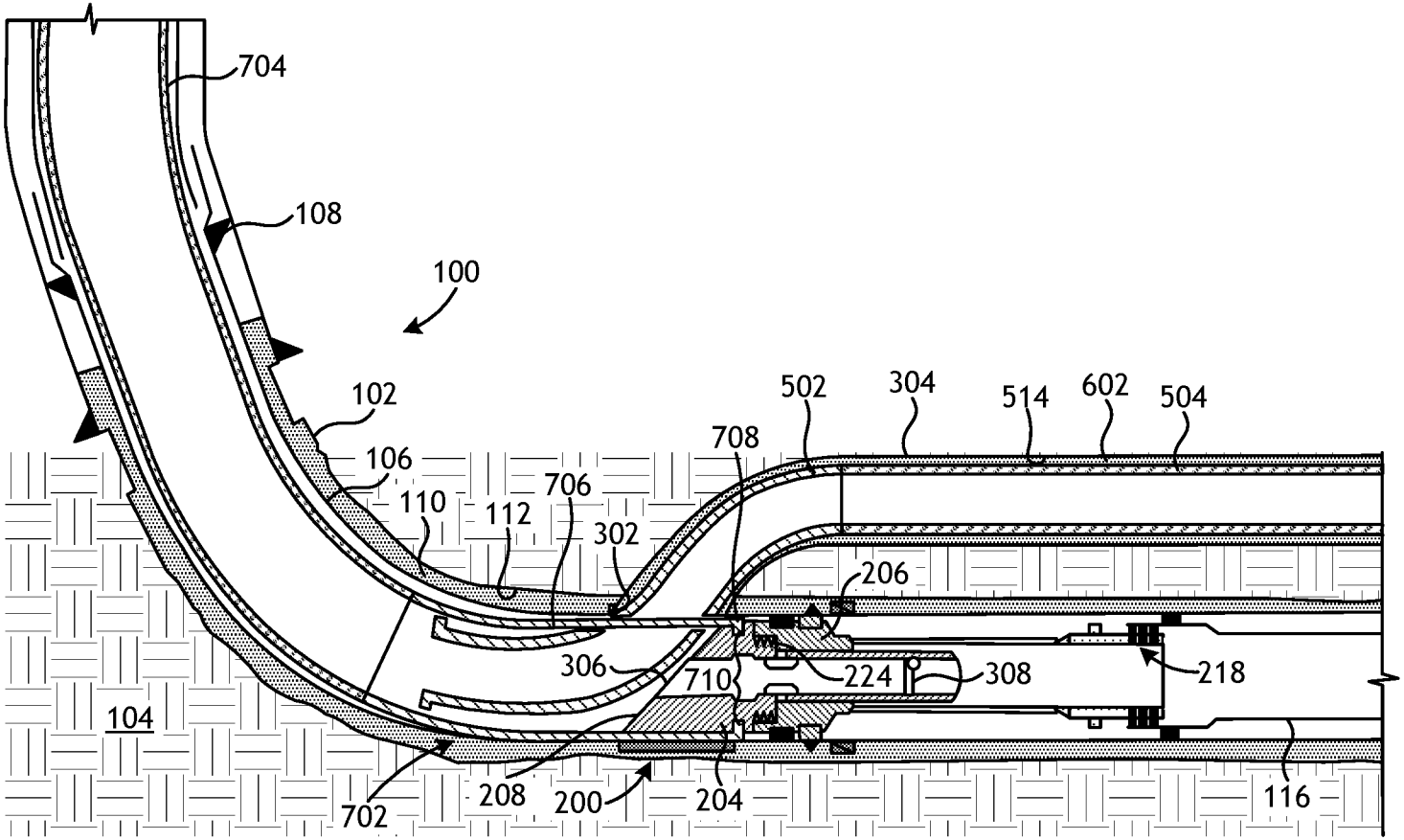
FIG. 7 depicts a washover assembly advanced into the parent wellbore to the whipstock and deflector assembly.

FIG. 7 depicts a washover assembly 702 advanced into the parent wellbore 102 to the assembly 200. The washover assembly 702 may be conveyed into the parent wellbore 102 as coupled to a work string 704, which could be the same as the work string 508 of FIG. 5. The washover assembly 702 may include a washover tool 706 used to cut through the portion of the lateral transition joint 502 extending into the parent wellbore 102 from the lateral wellbore 304. In some applications, for instance, the washover tool 706 includes a wash shoe (not labeled) at its distal end, which includes a plurality of cutters (e.g., tungsten carbide cutters). While rotating the work string 704, the cutters progressively mill through the portion of the lateral transition joint 502 extending into the parent wellbore 102. In at least one embodiment, a basket (not shown) may be included to retain and prevent cuttings and debris from falling into the parent wellbore 102.

The washover tool 706 may also include a washover engagement device 708 configured to locate and couple to a washover coupling 710 provided on the outer radial surface of the washover whipstock 204. In some embodiments, the washover engagement device 708 may comprise a snap collet that includes a plurality of flexible collet fingers. In other embodiments, however, the washover engagement device 708 may comprise any type of mechanism capable of coupling to the washover whipstock 204 at the washover coupling 710, such as a profiled engagement, a snap ring, a shear ring, etc. In some embodiments, as illustrated, the washover coupling 710 may comprise one or more grooves, indentations, protrusions, or profiles defined on the outer radial surface of the washover whipstock 204. In other embodiments, however, the engagement between the washover engagement device 708 and the washover coupling 710 may comprise a magnetic engagement or the like. The washover coupling 710 may comprise any device or mechanism that allows the washover engagement device 708 to couple thereto, and will depend primarily on the specific design of the washover engagement device 708.

As the washover assembly 702 is advanced within the parent wellbore 102, the washover tool 706 operates to sever the portion of the lateral transition joint 502 extending into the parent wellbore 102. Advancing the washover assembly 702 further downhole allows the washover tool 706 to extend about the outer diameter of the washover whipstock 204 to enable the washover engagement device 708 to locate and engage the washover coupling 710. This process is sometimes referred to in the industry as "washing over" a deflector or whipstock (i.e., the washover whipstock 204).

Once the washover engagement device 708 is suitably secured to the washover whipstock 204 at the washover coupling 710, the work string 704 may then be pulled in the uphole direction (i.e., toward the surface of the well) to separate the washover whipstock 204 from the orienting latch anchor 206, which remains firmly secured within the parent wellbore 102. More particularly, pulling on the work string 704 in the uphole direction will place an axial load on the releasable orienting coupling 224 that eventually overcomes the engagement force at the releasable orienting coupling 224. Upon overcoming the engagement force, the washover whipstock 204 is separated from the orienting latch anchor 206 and may then be retrieved to the surface location as coupled to the work string 704. Removing the washover whipstock 204 from the orienting latch anchor 206 exposes the releasable orienting coupling 224, which may now be able to receive and otherwise couple to other downhole tools or devices included in the assembly 200.

Figure 8:
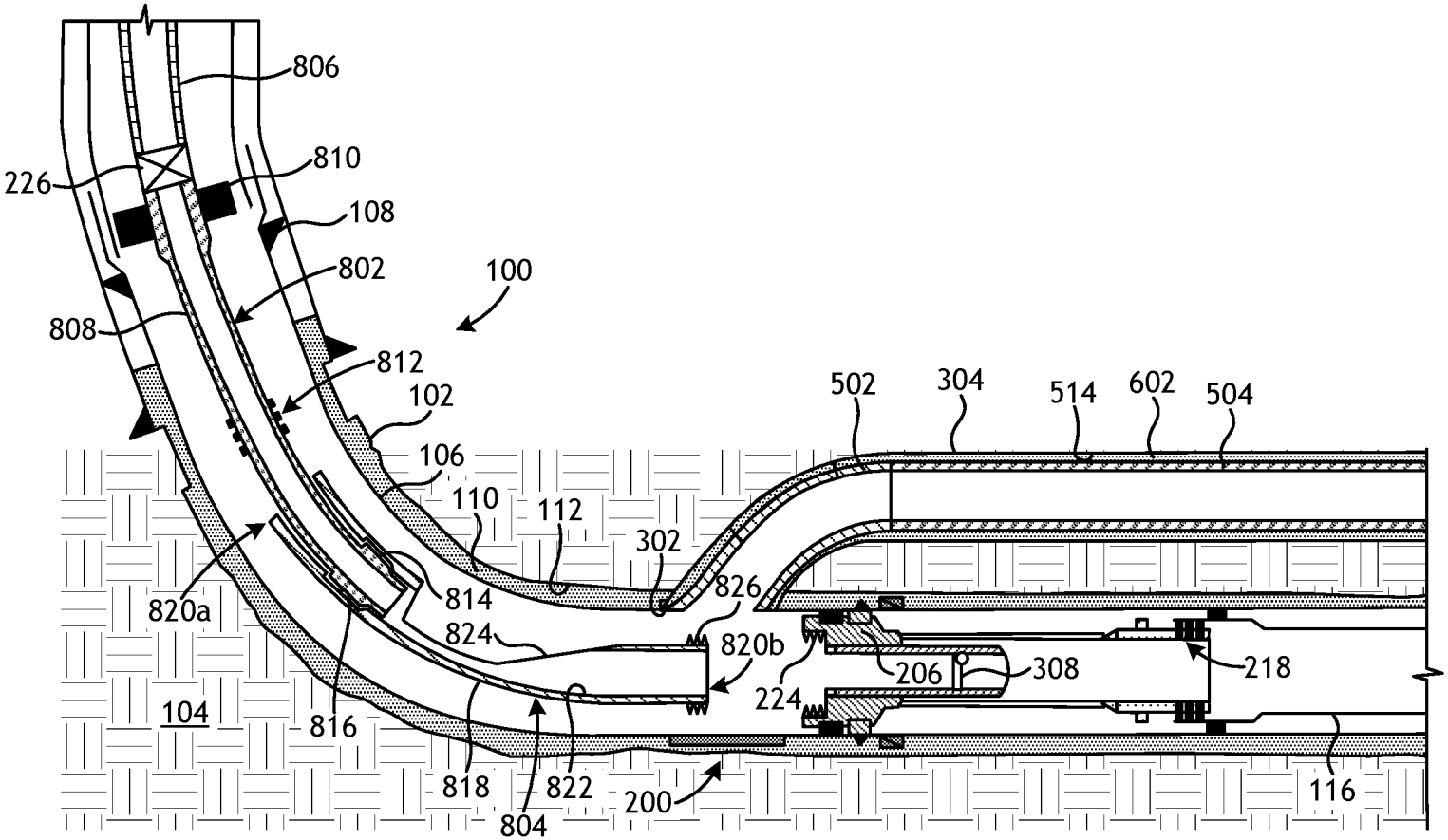
FIG. 8 depicts a junction isolation tool being used to convey a workover whipstock into the parent wellbore.

FIG. 8 depicts a junction isolation tool 802 being used to convey a workover whipstock 804 into the parent wellbore 102. Conveying the workover whipstock 804 downhole with the junction isolation tool 802 may prove advantageous in eliminating the need to run the junction isolation tool 802 in a separate downhole trip. The uphole end of the junction isolation tool 802 may be operatively coupled to a work string 806, which may be the same as or similar to either of the work strings 508, 704 of FIGS. 5 and 7, respectively. In some embodiments, the junction isolation tool 802 may include or otherwise employ the MWD tool 226 to monitor the progress of the workover whipstock 804 within the parent wellbore 102 and help generally orient the workover whipstock 804 with respect to the casing exit 302.

As illustrated, the junction isolation tool 802 may include an elongate body 808 that provides a retrievable packer 810, one or more radial seals 812, and a releasable connection 814. The retrievable packer 810 may be disposed about the body 808 at or near its upper end and may comprise an elastomeric material. Upon actuation (e.g., mechanically, hydraulically, etc.), the elastomeric material may radially expand into sealing engagement with the inner wall of a conduit or tubing, such as the inner wall of the casing 106, as described below. The radial seals 812 may be configured to sealingly engage an inner radial surface of the lateral transition joint 502, and thereby provide fluid isolation within the lateral wellbore 304. The radial seals 812 may include, but are not limited to, metal-to-metal seals, elastomeric seals (e.g., O-rings or the like), crimp seals, and any combination thereof.

The junction isolation tool 802 is coupled to the workover whipstock 804 by extending longitudinally into the interior of the workover whipstock 804 and having the releasable connection 814 locate and engage a connection point 816 provided on the inner radial surface of the workover whipstock 804. The releasable connection 814 allows the junction isolation tool 802 to be coupled to and subsequently separated from the workover whipstock 804. Consequently, the releasable connection 814 and associated connection point 816 may comprise any connection mechanism or device that can be repeatedly locked and released as desired such as, but not limited to, a collet and profile assembly, a latching mechanism, a shearable device (e.g., one or more shear screws, shear pins, shear bolts, a shear ring, etc.), a dissolvable connection, a disappearing-type (degradable) connection, a pressure-release connection, a magnetic-release connection, and any combination thereof.

The workover whipstock 804 includes an elongate body 818 having a first or "upper" end 820*a*, a second or "lower" end 820*b*, and an inner bore 822 that extends longitudinally between the first and second ends 820*a,b*. The connection point 816 may be provided and otherwise defined at or near the first end 820*a* on the inner wall of the body 818. In some embodiments, the connection point 816 may provide and otherwise define an upstop shoulder 902 (FIG. 9) on its uphole end, and the releasable connection 814 may correspondingly provide and otherwise define a shoulder 904 (FIG. 9) on its uphole end. In such embodiments, the releasable connection 814 will be unable to pass through the connection point 816 in the uphole direction but will instead locate and land in the connection point 816.

A deflector face 824 is provided at an intermediate location between the upper and lower ends 820*a,b* and comprises an angled surface used to deflect the junction isolation tool 802 into the lateral wellbore 304.

A mating interface 826 may be provided on the outer radial surface of the body 818 at or near the lower end 820*b*. The mating interface 826 may be configured to locate and mate with the releasable orienting coupling 224 of the orienting latch anchor 206. In some embodiments, the mating interface 826 may include one or more spring-loaded keys that exhibit a unique profile or pattern configured to locate and mate with the releasable orienting coupling 224. Since the releasable orienting coupling 224 includes an orienting muleshoe, attaching the mating interface 826 to the releasable orienting coupling 224 also serves to angularly orient the workover whipstock 804 and, more particularly, the deflector face 824, relative to the casing exit 302. The MWD tool 226 may be able to monitor the angular orientation of the deflector face 824 with respect to the casing exit 302 to within +/−15° and thereby help a well operator provide a general angular orientation. Engagement between the mating interface 826 and the releasable orienting coupling 224, however, may fully orient the deflector face 824 to the desired orientation. Once the workover whipstock 804 is properly connected to the orienting latch anchor 206 at the releasable orienting coupling 224, the junction isolation tool 802 may be detached from the workover whipstock 804.

Figure 9:
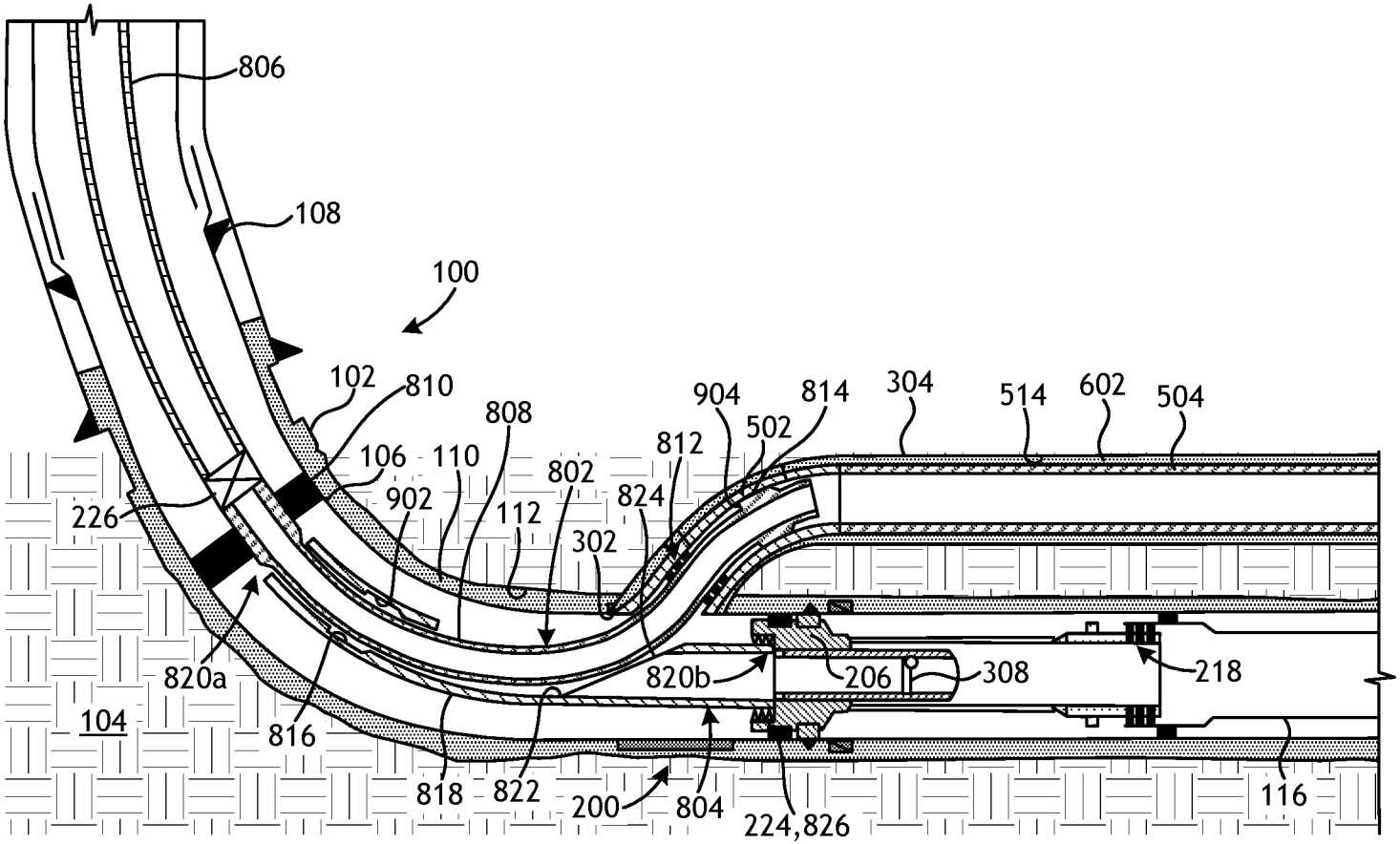
FIG. 9 depicts the workover whipstock as coupled to the orienting latch anchor at the releasable orienting connection.

FIG. 9 depicts the workover whipstock 804 as coupled to the orienting latch anchor 206 at the releasable orienting coupling 224. As mentioned above, the workover whipstock 804 is advanced within the parent wellbore 102 until the mating interface 826 locates and engages the releasable orienting coupling 224, which secures the workover whipstock 804 to the orienting latch anchor 206 and simultaneously angularly aligns the deflector face 824 with the casing exit 302. Once the workover whipstock 804 is connected to the orienting latch anchor 206, the junction isolation tool 802 may be detached from the workover whipstock 804 by applying an axial load to the junction isolation tool 802 via the work string 806 in the downhole direction (i.e., to the right in FIG. 9). The axial load may be transferred to the releasable connection 814 as engaged with the workover whipstock 804 at the connection point 816 provided on the inner radial surface of the workover whipstock 804. Once a predetermined axial load is assumed, the releasable connection 814 detaches from the connection point 816 and the junction isolation tool 802 may then be free to move with respect to the workover whipstock 804.

Once free, the junction isolation tool 802 may be advanced into the lateral wellbore 304 by engaging the deflector face 824, which deflects the junction isolation tool 802 into the lateral wellbore 304 via the casing exit 302. As the junction isolation tool 802 advances into the lateral wellbore 304, the radial seals 812 sealingly engage the inner radial surface of the lateral transition joint 502, and thereby provide fluid isolation within the lateral liner 504. Once the junction isolation tool 802 extends into the lateral wellbore 304 and the radial seals 812 sealingly engage the lateral transition joint 502, the retrievable packer 810 of the junction isolation tool 802 may be actuated to radially expand into sealing engagement with the inner wall of the casing 106. Actuating the retrievable packer 810 also serves to fix the junction isolation tool 802 in the parent wellbore 102 both axially and radially.

With the retrievable packer 810 actuated and the radial seals 812 sealingly engaged against the inner radial surface of the lateral transition joint 502, the lateral wellbore 304 may be fluidly isolated from upper portions of the parent wellbore 102. Moreover, the retrievable packer 810 and the radial seals 812 may provide the pressure rating capabilities required to undertake one or more wellbore operations within the lateral wellbore 304. Example wellbore operations that may be undertaken in the lateral wellbore 304 include, but are not limited to, hydraulic fracturing, water injection, steam injection, gravel packing, or other types of well stimulation.

In undertaking a hydraulic fracturing operation, one or more wellbore projectiles (not shown) may be pumped into the lateral wellbore 304 via the work string 806 and the junction isolation tool 802. The wellbore projectiles, which may include balls, darts, plugs, etc., may each be configured to locate and land on an associated sliding sleeve that forms part of a lateral completion assembly included in the lateral liner 504 and otherwise positioned within the lateral wellbore 304. When a given wellbore projectile properly lands on an associated sliding sleeve within the lateral liner 504, a seal is generated at the sliding sleeve and fluid pressure within the work string 806 and the lateral liner 504 can be increased to move the sliding sleeve to an open position. In the open position, the sliding sleeve moves axially within the lateral liner 504 and exposes one or more flow ports defined in the lateral liner to facilitate fluid communication between the lateral liner 504 and the surrounding formation 104. With the sliding sleeve in the open position, fluid may be injected into the surrounding formation 104 under pressure via the exposed flow ports and thereby hydraulically fracture the surrounding formation 104, which results in a network of fractures extending radially outward from the lateral wellbore 304.

With the wellbore operations (e.g., hydraulic fracturing) completed in the lateral wellbore 304, the junction isolation tool 802 may be retracted back into the parent wellbore 102 and re-attached to the workover whipstock 804. This may be accomplished by first deactivating (radially retracting) the retrievable packer 810 and then placing an axial load on the junction isolation tool 802 in the uphole direction (i.e., to the left in FIG. 9) via the work string 806. Under the force of the axial load, the junction isolation tool 802 will be pulled back into the parent wellbore 102 and uphole until the releasable connection 814 once again locates and engages the connection point 816 of the workover whipstock 804. In some embodiments, as indicated above, the connection point 816 may provide the upstop shoulder 902 on its uphole end and the releasable connection 814 may correspondingly provide the opposing shoulder 904 on its uphole end. As a result, the shoulder 904 of the releasable connection 814 will engage the opposing the upstop shoulder 902 of the connection point 816 and the releasable connection 814 will, therefore, be unable to pass through the connection point 816 in the uphole direction.

Figure 10:
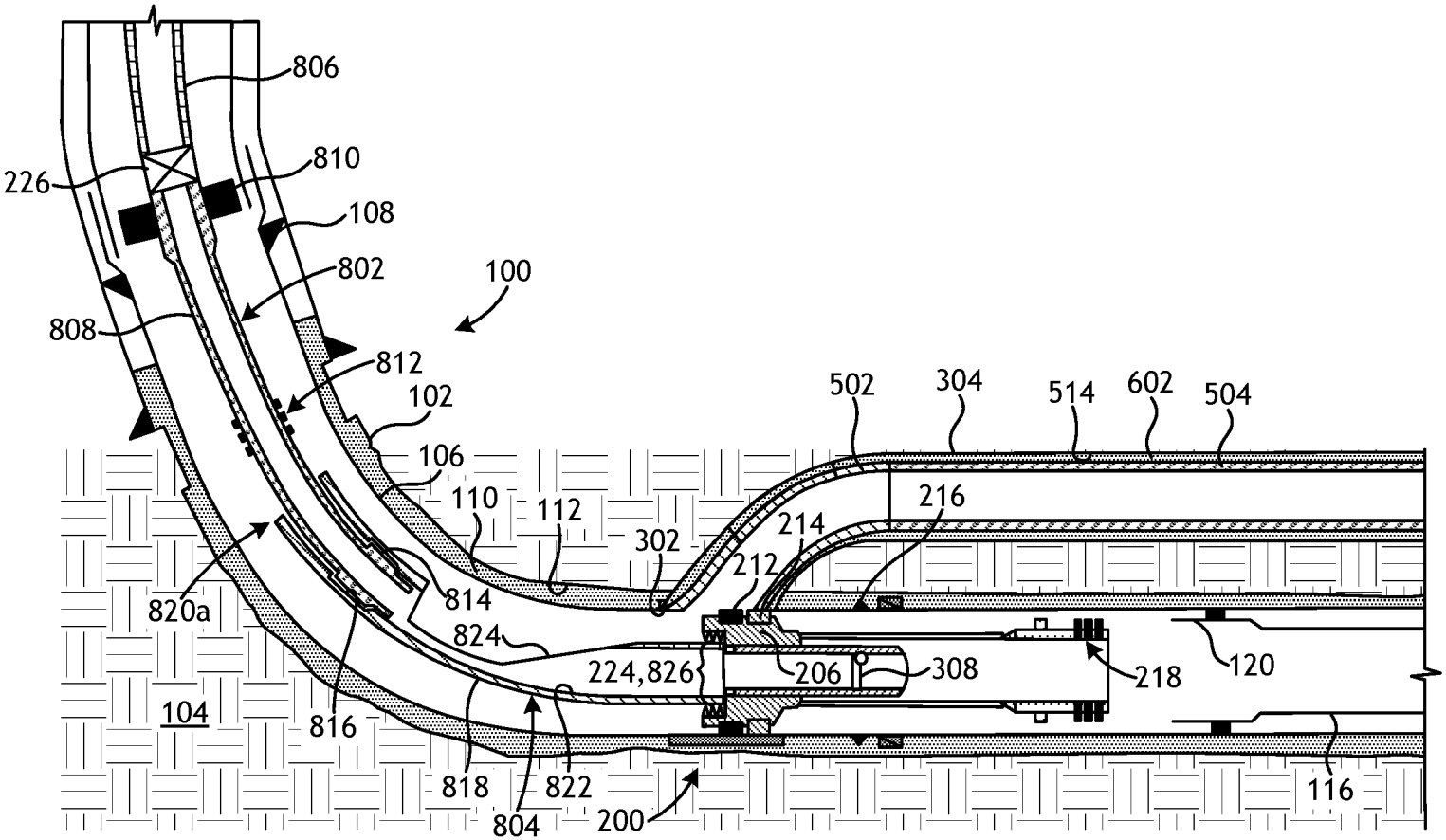
FIG. 10 depicts the junction isolation tool retracted back into the parent wellbore and re-engaged with the workover whipstock.

FIG. 10 depicts the junction isolation tool 802 retracted back into the parent wellbore 102 and re-engaged with the workover whipstock 804. Once the releasable connection 814 locates and engages the connection point 816 of the workover whipstock 804 an axial load may be applied on the junction isolation tool 802 in the uphole direction via the work string 806 to remove the workover whipstock 804 from the parent wellbore 102. Being able to re-engage the workover whipstock 804 with the junction isolation tool 802 in the same run into the parent wellbore 102 eliminates the need for a separate trip to separately retrieve the workover whipstock 804.

In some embodiments, the axial load applied to the junction isolation tool 802 may result in the removal of both the workover whipstock 804 and the orienting latch anchor 206, and thereby leaving an open parent wellbore 102. Such an embodiment is illustrated in FIG. 10. In such embodiments, the engagement force between the latch profile 214 and the latch coupling 216 may be less than the engagement force between the mating interface 826 and the releasable orienting coupling 224. As a result, once the axial load applied to the junction isolation tool 802 reaches a predetermined limit, the latch profile 214 may disengage from the latch coupling 216, thereby freeing the workover whipstock 804 and the orienting latch anchor 206 from the casing 106. Uphole movement of the junction isolation tool 802 may then disengage the lower stinger assembly 218 from the seal bore 220 of the lower liner 116 as the workover whipstock 804 and the orienting latch anchor 206 are retrieved to the surface location using the work string 806. The fluid loss control device 308 is also retrieved to the surface location along with workover whipstock 804, which eliminates two trips downhole; one trip to separately install the fluid loss control device 308 prior to milling and drilling the lateral wellbore 304, and a second trip to separately retrieve the fluid loss control device 308.

In other embodiments, however, the axial load applied to the junction isolation tool 802 may result in separating the workover whipstock 804 from the orienting latch anchor 206, and the orienting latch anchor 206 remains coupled to the casing 106. In such embodiments, the engagement force between the latch profile 214 and the latch coupling 216 may be greater than the engagement force between the mating interface 826 and the releasable orienting coupling 224. As a result, once the axial load applied to the junction isolation tool 802 reaches a predetermined limit, the mating interface 826 may disengage from the releasable orienting coupling 224, thereby freeing the workover whipstock 804 from the orienting latch anchor 206 and allowing the junction isolation tool 802 to retrieve the workover whipstock 804 to the surface location using the work string 806.

Embodiments disclosed herein include:

A. A method that includes conveying a lateral transition joint into a parent wellbore lined with casing and deflecting the lateral transition joint into a lateral wellbore with a washover whipstock coupled to an orienting latch anchor secured to the casing, separating the washover whipstock from the orienting latch anchor with a washover tool, and thereby exposing a releasable orienting coupling of the orienting latch anchor, conveying a workover whipstock coupled to a junction isolation tool into the parent wellbore and coupling the workover whipstock to the orienting latch anchor at the releasable orienting coupling, separating the junction isolation tool from the workover whipstock and advancing the junction isolation tool into the lateral wellbore, retracting the junction isolation tool into the parent wellbore and re-attaching the junction isolation tool to the workover whipstock, and removing the workover whipstock from the parent wellbore with the junction isolation tool.

B. A well system that includes a washover whipstock coupled to an orienting latch anchor and conveyable into a parent wellbore lined with casing to a location, the orienting latch anchor being secured to the casing at the location, a lateral transition joint secured in a lateral wellbore extending from the parent wellbore, a washover tool conveyable into the parent wellbore and configured to couple to the washover whipstock to separate the washover whipstock from the orienting latch anchor and expose a releasable orienting coupling of the orienting latch anchor, and a workover whipstock coupled to a junction isolation tool and conveyable into the parent wellbore to couple to the orienting latch anchor at the releasable orienting coupling, wherein the junction isolation tool is separable from the workover whipstock to advance into the lateral wellbore, and wherein the junction isolation tool is configured to be re-attached to the workover whipstock to remove the workover whipstock from the parent wellbore.

Each of embodiments A and B may have one or more of the following additional elements in any combination: Element 1: further comprising conveying a fluid loss control device into the parent wellbore simultaneously with the washover whipstock and the orienting latch anchor. Element 2: wherein conveying the lateral transition joint into the lateral wellbore comprises deflecting the lateral transition joint into the lateral wellbore with the washover whipstock, deflecting a lateral liner coupled to a bottom end of the lateral transition joint into the lateral wellbore with the washover whipstock, and securing the lateral liner in the lateral wellbore with cement. Element 3: wherein the washover tool includes a washover engagement device and the washover whipstock includes a washover coupling, and wherein coupling the washover tool to the washover whipstock comprises coupling the washover engagement device to the washover coupling. Element 4: further comprising coupling the junction isolation tool to the workover whipstock by engaging a releasable connection of the junction isolation tool at a connection point provided on the workover whipstock. Element 5: wherein separating the junction isolation tool from the workover whipstock comprises applying an axial load to the junction isolation tool in a downhole direction, and detaching the releasable connection from the connection point with the axial load assumed by the releasable connection. Element 6: wherein re-attaching the junction isolation tool to the workover whipstock comprises re-engaging the releasable connection with the connection point. Element 7: wherein coupling the workover whipstock to the orienting latch anchor at the releasable orienting coupling comprises engaging a mating interface provided on the workover whipstock with the releasable orienting coupling, and angularly orienting the workover whipstock with respect to a casing exit defined in the casing with the releasable orienting coupling. Element 8: wherein advancing the junction isolation tool into the lateral wellbore comprises deflecting the junction isolation tool into the lateral wellbore with the workover whipstock. Element 9: further comprising sealingly engaging an inner radial surface of the lateral transition joint with one or more radial seals provided on the junction isolation tool as the junction isolation tool advances into the lateral wellbore, actuating a retrievable packer of the junction isolation tool to sealingly engage an inner wall of the casing, and undertaking a wellbore operation within the lateral wellbore. Element 10: wherein removing the workover whipstock from the parent wellbore comprises placing an axial load on the junction isolation tool in an uphole direction, separating the orienting latch anchor from the casing, and removing the workover whipstock, the orienting latch anchor, and a fluid loss control device coupled to the orienting latch anchor from the parent wellbore with the junction isolation tool. Element 11: wherein removing the workover whipstock from the parent wellbore comprises placing an axial load on the junction isolation tool in an uphole direction, and separating the workover whipstock from the orienting latch anchor at the releasable coupling.

Element 12: wherein the washover tool includes a washover engagement device configured to be coupled to a washover coupling provided on an outer diameter of the washover whipstock. Element 13: further comprising a releasable connection provided on the junction isolation tool, and a connection point provided on the workover whipstock and configured to receive the releasable connection to couple the junction isolation tool to the workover whipstock. Element 14: wherein an uphole end of the releasable connection defines an upstop shoulder and an uphole end of the connection point defines an opposing shoulder. Element 15: further comprising a mating interface provided on the workover whipstock and engageable with the releasable orienting coupling to couple the workover whipstock to the orienting latch anchor. Element 16: wherein the releasable orienting coupling includes an orienting muleshoe that angularly orients the workover whipstock with respect to a casing exit defined in the casing upon coupling the workover whipstock to the orienting latch anchor. Element 17: wherein the junction isolation tool removes the workover whipstock from the parent wellbore by separating the orienting latch anchor from the casing. Element 18: wherein the junction isolation tool removes the workover whipstock from the parent wellbore by separating the workover whipstock from the orienting latch anchor at the releasable coupling.

By way of non-limiting example, exemplary combinations applicable to A and B include: Element 4 with Element 5; Element 4 with Element 6; Element 8 with Element 9; Element 13 with Element 14; and Element 15 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A method, comprising:

conveying a lateral transition joint into a parent wellbore lined with casing and deflecting the lateral transition joint into a lateral wellbore with a washover whipstock coupled to an orienting latch anchor secured to the casing;

separating the washover whipstock from the orienting latch anchor with a washover tool, and thereby exposing a releasable orienting coupling of the orienting latch anchor;

conveying a workover whipstock coupled to a junction isolation tool into the parent wellbore and coupling the workover whipstock to the orienting latch anchor at the releasable orienting coupling;

separating the junction isolation tool from the workover whipstock and advancing the junction isolation tool into the lateral wellbore;

retracting the junction isolation tool into the parent wellbore and re-attaching the junction isolation tool to the workover whipstock; and removing the workover whipstock from the parent wellbore with the junction isolation tool.

2. The method of claim 1, further comprising conveying a fluid loss control device into the parent wellbore simultaneously with the washover whipstock and the orienting latch anchor.

3. The method of claim 1, wherein conveying the lateral transition joint into the lateral wellbore comprises:

deflecting the lateral transition joint into the lateral wellbore with the washover whipstock;

deflecting a lateral liner coupled to a bottom end of the lateral transition joint into the lateral wellbore with the washover whipstock; and securing the lateral liner in the lateral wellbore with cement.

4. The method of claim 1, wherein separating the washover whipstock from the orienting latch anchor with the washover tool is preceded by:

severing a portion of the lateral transition joint extending into the parent wellbore with the washover tool; and coupling the washover tool to the washover whipstock.

5. The method of claim 4, wherein the washover tool includes a washover engagement device and the washover whipstock includes a washover coupling, and wherein coupling the washover tool to the washover whipstock comprises coupling the washover engagement device to the washover coupling.

6. The method of claim 1, further comprising coupling the junction isolation tool to the workover whipstock by engaging a releasable connection of the junction isolation tool at a connection point provided on the workover whipstock.

7. The method of claim 6, wherein separating the junction isolation tool from the workover whipstock comprises:

applying an axial load to the junction isolation tool in a downhole direction; and detaching the releasable connection from the connection point with the axial load assumed by the releasable connection.

8. The method of claim 6, wherein re-attaching the junction isolation tool to the workover whipstock comprises re-engaging the releasable connection with the connection point.

9. The method of claim 1, wherein coupling the workover whipstock to the orienting latch anchor at the releasable orienting coupling comprises:

engaging a mating interface provided on the workover whipstock with the releasable orienting coupling; and angularly orienting the workover whipstock with respect to a casing exit defined in the casing with the releasable orienting coupling.

10. The method of claim 1, wherein advancing the junction isolation tool into the lateral wellbore comprises sealingly engaging an inner radial surface of the lateral transition joint with one or more radial seals provided on the junction isolation tool as the junction isolation tool advances into the lateral wellbore;

actuating a retrievable packer of the junction isolation tool to sealingly engage an inner wall of the casing; and undertaking a wellbore operation within the lateral wellbore.

11. The method of claim 1, wherein removing the workover whipstock from the parent wellbore comprises:

placing an axial load on the junction isolation tool in an uphole direction;

separating the orienting latch anchor from the casing; and removing the workover whipstock, the orienting latch anchor, and a fluid loss control device coupled to the orienting latch anchor from the parent wellbore with the junction isolation tool.

12. The method of claim 1, wherein removing the workover whipstock from the parent wellbore comprises:

placing an axial load on the junction isolation tool in an uphole direction; and separating the workover whipstock from the orienting latch anchor at the releasable coupling.

13. A well system, comprising:

a lateral transition joint secured in a lateral wellbore extending from a parent wellbore lined with casing;

a washover whipstock coupled to an orienting latch anchor and configured to secure to the casing, the orienting latch anchor comprising a releasable orienting coupling configured to be exposed when the orienting latch anchor is separated from the washover whipstock;

a washover tool configured to be conveyed into the parent wellbore and configured to separate the washover whipstock from the orienting latch anchor;

a workover whipstock coupled to a junction isolation tool configured to be conveyed into the parent wellbore to couple to the releasable orienting coupling of the orienting latch anchor;

wherein the junction isolation tool is configured to separate from the workover whipstock when advancing into the lateral wellbore, and wherein the junction isolation tool is configured to re-attach to the workover whipstock when removing the workover whipstock from the parent wellbore.

14. The well system of claim 13, wherein the washover tool includes a washover engagement device configured to be coupled to a washover coupling provided on an outer diameter of the washover whipstock.

15. The well system of claim 13, further comprising:

a releasable connection provided on the junction isolation tool; and a connection point provided on the workover whipstock and configured to receive the releasable connection to couple the junction isolation tool to the workover whipstock.

16. The well system of claim 15, wherein an uphole end of the releasable connection defines an upstop shoulder and an uphole end of the connection point defines an opposing shoulder.

17. The well system of claim 13, further comprising a mating interface provided on the workover whipstock and engageable with the releasable orienting coupling to couple the workover whipstock to the orienting latch anchor.

18. The well system of claim 13, wherein the releasable orienting coupling includes an orienting muleshoe that angularly orients the workover whipstock with respect to a casing exit defined in the casing upon coupling the workover whipstock to the orienting latch anchor.

19. The well system of claim 13, wherein the junction isolation tool removes the workover whipstock from the parent wellbore by separating the orienting latch anchor from the casing.

20. The well system of claim 13, wherein the junction isolation tool removes the workover whipstock from the parent wellbore by separating the workover whipstock from the orienting latch anchor at the releasable coupling.

* * * * *